US007344819B2

(12) United States Patent
Ikami et al.

(10) Patent No.: US 7,344,819 B2
(45) Date of Patent: Mar. 18, 2008

(54) MANUFACTURING METHOD FOR A TONER

(75) Inventors: Jun Ikami, Ichinomiya (JP); Masateru Kawamura, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 434 days.

(21) Appl. No.: 10/995,324

(22) Filed: Nov. 24, 2004

(65) Prior Publication Data

US 2005/0118523 A1 Jun. 2, 2005

(30) Foreign Application Priority Data

Nov. 28, 2003 (JP) ..... 2003-399696

(51) Int. Cl.
*G03G 5/00* (2006.01)

(52) U.S. Cl. ..... 430/137.14; 430/137.17

(58) Field of Classification Search ..... 430/137.14, 430/137.17
See application file for complete search history.

(56) References Cited

U.S. PATENT DOCUMENTS 5,928,831 A * 7/1999 Nakamura ..... 430/137.14

FOREIGN PATENT DOCUMENTS

JP 63-25664 A 2/1988
JP 10-39540 A 2/1998

* cited by examiner

*Primary Examiner*—Mark A. Chapman
(74) *Attorney, Agent, or Firm*—Oliff & Berridge, PLC

(57) ABSTRACT

A method for manufacturing toner includes combining a polymer resin and an organic solvent to obtain an oil-based solvent; combining a dispersion stabilizer with water to obtain a water-based solvent; adding an amphiphilic solvent to the water-based solvent; emulsifying the oil-based solvent in the water-based solvent to form emulsion particles; and removing the organic solvent from the emulsion particles.

20 Claims, 4 Drawing Sheets

MANUFACTURING METHOD FOR A TONER

INCORPORATION BY REFERENCE

This application claims priority from JP 2003-399696, filed Nov. 28, 2003, the subject matter of which is incorporated herein in its entirety by reference thereto.

BACKGROUND

This invention relates to a manufacturing method for a toner that can be used as an electrophotographic developing agent.

Methods such as those disclosed in Japanese Unexamined Patent Applications S63-25664 and H10-39540 are widely known as manufacturing methods for toners to be used as electrophotographic developing agents. In these types of methods, the polymer resin that is the main ingredient in the toner is dissolved in an organic solvent and the resulting solution is emulsified in water. Then, the solvent is removed by heating, vacuum suction or by an alcohol drip, and the toner is produced.

SUMMARY

However, in the above methods, when the solubility of the organic solvent that dissolves the polymer resin is low with regard to water, the shape of the resultant toner is not spherical, and problems arise in that the toner takes on an amorphous or indeterminate form. Therefore, in order to manufacture a spherical toner, it has been necessary in the past to use an organic solvent with high solubility in water.

If the selection of organic solvents that can be used is limited to only those with high solubility in water, the number of organic solvents from which to choose is narrowed, and it becomes necessary to use either a highly flammable solvent, or a solvent with a high degree of toxicity to humans. Further, when using solvents with high flammability or high toxicity to humans, a manufacturer must pay particular attention to safety in the manufacturing processes of the toner.

The inventors have recognized a need to provide a manufacturing method for a toner that can use a wide range of organic solvents, and that can safely manufacture spherical toner.

In embodiments, an oil-based solvent is obtained by combining a polymer resin and an organic solvent; a water-based solvent is obtained by combining a dispersion stabilizer with water; the oil-based solvent is emulsified in the water-based solvent; and the organic solvent is removed from the emulsion particles in the emulsion In embodiments, an amphiphilic solvent that is soluble in both an organic solvent and water is added to a water-based solvent, either before or after a dispersion stabilizer is combined with water. By ensuring that an amount of amphiphilic solvent added is approximately 1.8 times or less greater than a phase point amount of amphiphilic solvent in an organic solvent and water, it is possible to obtain a spherical toner with high yield regardless of an organic solvent's degree of solubility in water. If an amount of amphiphilic solvent added is more than approximately 1.8 times a phase point amount, the polymer resin is aggregated and little particles can be formed. By ensuring that an amount of amphiphilic solvent added is approximately 0.4 times or more greater than a phase point amount of amphiphilic solvent in an organic solvent and water, it is possible to obtain a spherical toner regardless of an organic solvent's degree of solubility in water. If an amount of amphiphilic solvent added is less than approximately 0.4 times a phase point amount, toner particles take on an amorphous or indeterminate form to prevent a decrease in a surface area of toner particles along with a decrease in a volume of toner particles, and thus spherical toner particles cannot be obtained.

In embodiments, a method for manufacturing toner includes combining a polymer resin and an organic solvent to obtain an oil-based solvent; combining a dispersion stabilizer with water to obtain a water-based solvent; adding an amphiphilic solvent to the water-based solvent; emulsifying the oil-based solvent in the water-based solvent to form emulsion particles; and removing the organic solvent from the emulsion particles.

By employing embodiments of toner manufacturing methods according to this invention, a range of organic solvents that can be used is broadened, and as it is possible to use organic solvents with low flammability or low toxicity to humans, toner can be manufactured safely. Furthermore, it is possible to obtain a spherical toner regardless of the organic solvents degree of solubility in water.

DETAILED DESCRIPTION OF EMBODIMENTS

Figure 1:
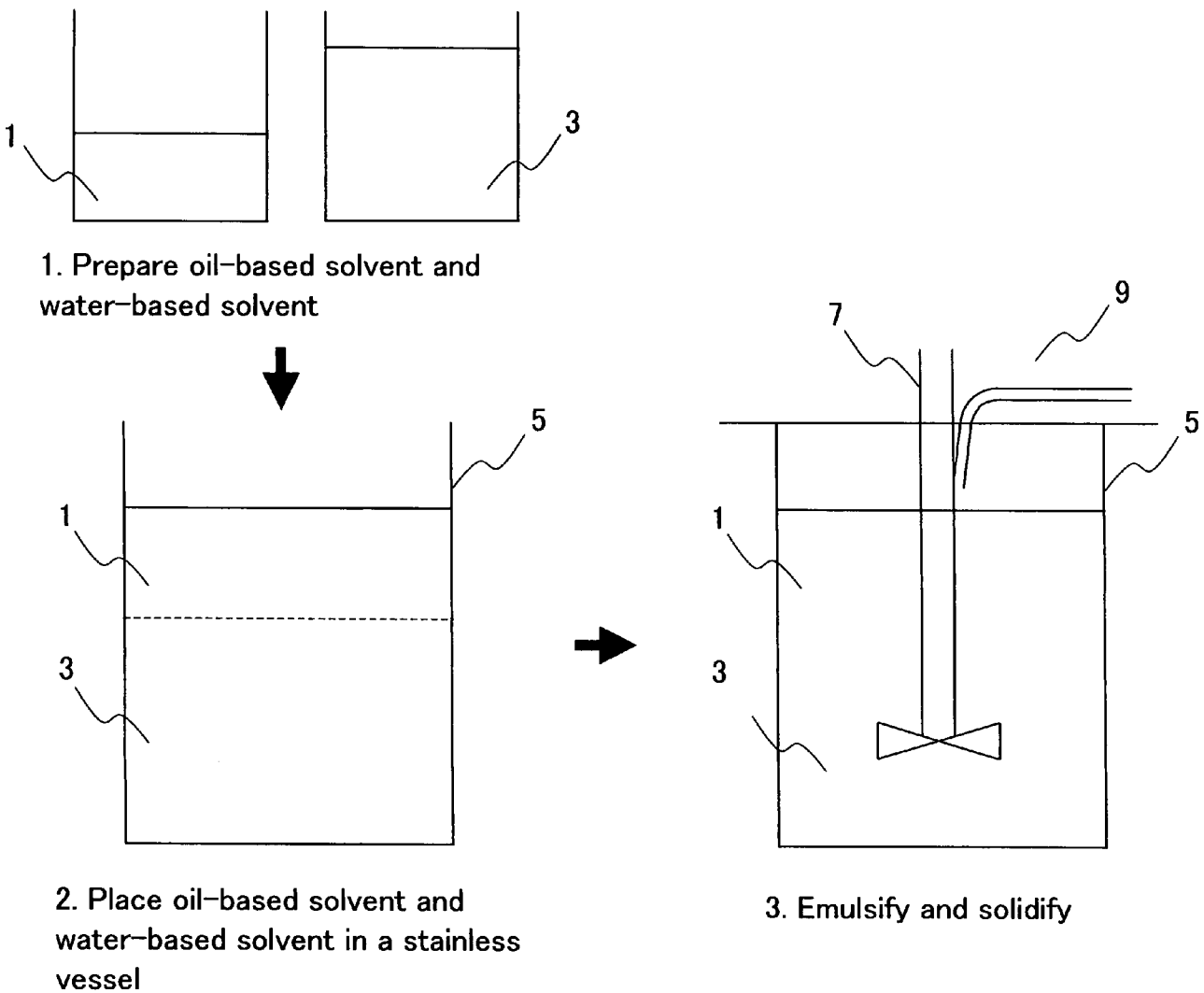
FIG. 1 is a schematic drawing illustrating an embodiment of a toner manufacturing method according to the invention.

Some reasons that it is possible to obtain a spherical toner regardless of an organic solvent's degree of solubility in water are as follows. In an emulsification process, a solution of polymer resin in organic solvent is emulsified in water. Emulsification particles (hereinafter referred to as toner particles) are thus generated, in which a polymer resin has been dissolved in an organic solvent and the organic solvent is surrounded by a dispersion stabilizer. In embodiments, sizes of toner particles can range from approximately several μm to between about 10 and about 20 μm.

In conventional manufacturing methods, when removing organic solvent from toner particles in a solvent removal process, toner particles take on an amorphous or indeterminate form in order to maintain a phase boundary energy between the toner particles and the solution. In other words, toner particles take on an amorphous or indeterminate form to prevent a decrease in a surface area of the toner particles along with a decrease in a volume of the toner particles.

In contrast, the inventors have discovered that if an appropriate amount of amphiphilic solvent is used in advance in a water-based solvent, an organic solvent is, to a certain extent, removed from toner particles through use of an amphiphilic solvent when an oil-based solvent is emulsified with the water-based solvent and toner particles are formed. The result is formation of toner particles that contain less organic solvent as compared to toner particles formed by conventional methods. Therefore, even if remaining organic solvent is removed from toner particles in a solvent removal process, the toner particles are prevented from taking on an amorphous or indeterminate form because the change in volume is small.

Phase point amount is defined as follows. An amphiphilic solvent is slowly dripped into a solution of A g of water and B g of organic solvent, until the entire solution becomes clear and colorless. At this point, the solution of water, amphiphilic solvent, and organic solvent is homogeneous. The amount of added amphiphilic solvent is C g. This point is a phase point of A g of water, B g of the organic solvent and C g of the amphiphilic solvent. This C g is the phase point amount of the amphiphilic solvent in A g of water and B g of the organic solvent.

In embodiments of this invention, phase point amount can be measured in the following way. After letting a solution containing A g of water and B g of organic solvent stand, the solution is separated into a water phase and an organic solvent phase. This solution is then agitated such that the water and organic solvent are mixed, and the entire solution becomes white and turbid due to light scattering as a result of a difference in refractive indicies of the water and the organic solvent at each compound's boundary. While the agitation of the white and turbid solution is continued, drops of the amphiphilic solvent are gradually added into the solution, and the water, the organic solvent and the amphiphilic solvent are mixed. After C g of the amphiphilic solvent are added, the solution becomes clear and colorless and the water, the organic solvent and the amphiphilic solvent form a homogeneous solution. This C g is the phase point amount of the amphiphilic solvent in A g of water and B g of organic solvent.

The frequency of drips of amphiphilic solvent and amount of amphiphilic solvent added in each drop can be one drop of 0.2 ml every 3 minutes in the vicinity of the phase point where the solution becomes clear and colorless. Further, in order to prevent volatilization of an organic solvent, the solution can be agitated within a hermetically sealed container except when adding amphiphilic solvent.

In embodiments, an amount of amphiphilic solvent to be added during an additive process can be approximately 1.8 times or less greater than a phase point amount of amphiphilic solvent in organic solvent and water. In other embodiments, an amount of amphiphilic solvent to be added during an additive process is approximately 1.75 times or less greater than a phase point amount of amphiphilic solvent in organic solvent and water. In such embodiments, it is possible to manufacture a high-yield toner. In various embodiments, an amount of amphiphilic solvent to be added during an additive process is approximately 0.4 to approximately 1.8 times greater than a phase point amount of amphiphilic solvent in organic solvent and water. In various other embodiments, an amount of amphiphilic solvent to be added during an additive process is approximately 0.45 to approximately 1.75 times greater than a phase point amount of amphiphilic solvent in organic solvent and water.

One or more widely known thermoplastic resins may be used as a polymer resin. In embodiments, polyester resins, styrene-acryl copolymers, ketone resins, epoxy resins, polyolefin resins, or combinations thereof may be used as a polymer resin.

In embodiments, an organic solvent may be an ester-type solvent such as butyl acetate or propyl acetate, hydrocarbon-type solvents such as toluene or xylene, a ketone-type solvent such as 2-hexanone, methyl isobutyl ketone or cyclohexanone, an ether-type solvent such as dibutylether or dihexylether, a halogenated solvent such as chloroform or chlorobenzene, or combinations thereof.

In embodiments, a dispersion stabilizer may be calcium phosphate, silica, alumina, titania, calcium carbonate, magnesium carbonate, clay, diatomaceous earth, bentonite, or combinations thereof.

In embodiments, a solvent may be removed by heat treatment, vacuum treatment, alcohol drip, spray dry or any combination of these processes.

An amphiphilic solvent is a solvent that is soluble in both aqueous and oil phases. In embodiments, an amphiphilic solvent may be an alcohol such as methanol, isopropyl alcohol (IPA), ethanol or normal propanol, or acetone, or any mixture of two or more of these.

In embodiments, it is acceptable to add a wax such as polyethylene wax to an oil-based solvent, and to include wax in the toner. Wax may be effective in preventing a toner from adhering to a roller during printing (in particular, to heated rollers) and from resulting in an offset. Furthermore, it is acceptable to add a coloring agent such as a colorant to an oil-based solvent, and to include a colorant in the toner. In embodiments, a colorant may be carbon black, magnetic powder, cyan, magenta, yellow or other widely known colorants used in electrophotographic developing agents.

By using an amphiphilic solvent as described above, it is possible to obtain a spherical toner, regardless of an organic solvent's degree of solubility in water. Thus, it is possible to obtain a spherical toner regardless of whether a solubility of an organic solvent in water is as low as 1.7 or less. Furthermore, it is possible to use a solvent with solubility in water of 1.7 or less, with low flammability and low toxicity to humans, making manufacture safe.

Solubility is a value at which an organic solvent is dissolved maximally in water, and may be defined using the following equation: Solubility={(Weight of the organic solvent)/(weight of the organic solvent)+(weight of the water)}×100

In embodiments, butyl acetate may be used as an organic solvent to safely manufacture a toner, as butyl acetate has not been identified as a poison.

In embodiments, a polyester resin may be used as a polymer resin. By using a basic polyester resin, a dispersion state of an oil-based solvent during an emulsification process is stabilized. Therefore, it may be possible to prevent aggregation between toner particles, and it may be possible to effectively obtain a spherical toner.

Examples are set forth hereinbelow and are illustrative of embodiments of the present invention. It will be apparent, however, that the invention can be practiced with many types of compositions and can have many different uses in accordance with the disclosure above and as pointed out hereinafter.

TABLE 1

| | | | Example | | | | | | | | |
|---|---|---|---|---|---|---|---|---|---|---|---|
| | | | 1 | 2 | 3 | 4 | 5 | 6 | 7 | 8 | 9 |
| Oil-based Solvent | Organic Solvent | Butyl Acetate (g) | 48.0 | 48.0 | 48.0 | | | | | | |
| | | Toluene (g) | | | | 48.0 | 48.0 | | | | |
| | | Chloroform (g) | | | | | | 48.0 | 48.0 | | |
| | | 2-Haxanone (g) | | | | | | | | 48.0 | 48.0 |
| | Polymer Resin | Polyester Resin (PES) (g) | 12.0 | 12.0 | 12.0 | 12.0 | 12.0 | 12.0 | 12.0 | 12.0 | 12.0 |
| | Wax (g) | | 0.5 | 0.5 | 0.5 | 0.5 | 0.5 | 0.5 | 0.5 | 0.5 | 0.5 |
| | Pigment (g) | | 0.6 | 0.6 | 0.6 | 0.6 | 0.6 | 0.6 | 0.6 | 0.6 | 0.6 |
| | Total (g) | | 61.1 | 61.1 | 61.1 | 61.1 | 61.1 | 61.1 | 61.1 | 61.1 | 61.1 |
| Aqueous Solvent | Distilled Water (g) | | 155.8 | 115.8 | 85.8 | 85.8 | 35.8 | 135.8 | 85.8 | 115.8 | 75.8 |
| | Amphiphilic Solvent | Methanol (g) | 80.0 | 120.0 | 150.0 | | | | | | |
| | | Acetone (g) | | | | 150.0 | 200.0 | | | | |
| | | IPA (g) | | | | | | 100.0 | 150.0 | 120.0 | 160.0 |
| | Dispersion Stabilizer | 10% TCP (g) | 4.2 | 4.2 | 4.2 | 4.2 | 4.2 | 4.2 | 4.2 | 4.2 | 4.2 |
| | Total Distilled Water (g) | | 159.6 | 119.6 | 89.6 | 89.6 | 39.6 | 139.6 | 89.6 | 119.6 | 79.6 |
| | Total (g) | | 240.0 | 240.0 | 240.0 | 240.0 | 240.0 | 240.0 | 240.0 | 240.0 | 240.0 |
| Properties | Phase Point Amount (g) | | 176.6 | 148.0 | 125.7 | 256.7 | 167.5 | 132.5 | 110.9 | 109.6 | 93.1 |
| | Ratio of Amount of Amphiphilic Solvent Added During Additive Process to Phase Point Amount | | 0.453 | 0.811 | 1.194 | 0.584 | 1.194 | 0.755 | 1.353 | 1.094 | 1.718 |
| | Solubility | | 0.8 | 0.8 | 0.8 | 0.045 | 0.045 | 0.7 | 0.7 | 1.7 | 1.7 |
| | Oil-phase Ratio | | 23.1 | 28.6 | 34.9 | 34.9 | 54.8 | 25.6 | 34.9 | 28.6 | 37.6 |
| | SEM Observed Data | | 2 | 2 | 2 | 2 | 2 | 2 | 2 | 2 | 2 |
| | Roundness | | 0.97 | 0.98 | 0.96 | 0.98 | 0.98 | 0.99 | 0.97 | 0.96 | 0.98 |
| | Yield (%) | | 89.2 | 83.3 | 85.4 | 90.8 | 95.3 | 86.3 | 89.1 | 90.9 | 88.8 |

EXAMPLE 1

A toner is manufactured in the following manner. First, as illustrated in Table 1, an oil-based solvent is obtained by mixing 12.0 g of a polyester resin (Mitsui Chemicals, Product Name: XPE2444, gel content 0 weight percent) used as the polymer resin, and 48.0 g of butyl acetate as the organic solvent, 0.5 g of polyethylene wax and 0.6 g of carbon black as the pigment.

Using a homogenizer in the mixture, the solution is agitated at room temperature for 10 minutes at 11,000 rpm. The total weight of the resultant oil-based solvent is 61.1 g, and the ratio of the polyester resin to the oil-based solvent is 19.6 weight percent.

Next, as illustrated in Table 1, by combining 155.8 g of distilled water, 4.2 g of a 10 weight percent triphosphate calcium (TCP) aqueous solution as a dispersion stabilizer (10 weight percent TCP) and 80.0 g of methanol as the amphiphilic solvent, a water-based solvent is obtained. Using a magnetic stirrer, the mixture is agitated at room temperature for 5 minutes. It is acceptable to add the methanol after mixing the distilled water with the 10 weight percent TCP solution, or it is acceptable to add the methanol to the distilled water alone before mixing. Further, it is also acceptable to add the methanol to an empty vessel first, and then to add the distilled water and 10 weight percent TCP.

Next, the oil-based solvent is emulsified in the water-based solvent according to the following method. As illustrated in FIG. 1, the oil-based solvent 1 and the water-based solvent 3 are placed in the stainless steel vessel 5, and using homogenizer 7 (Clearmix M Technique), the contents of the vessel are agitated for 10 minutes at 10,000 rpm and then sheared.

Next, the organic solvent is removed from the toner particles in the emulsion in the following manner. After emulsification, while continuing to agitate the solution, methanol is dripped into the solution along the axis of the homogenizer 7 using a drip device 9 (Electromagnetic Set Volume Pump, Iwaki). Methanol is added until the total weight of the solution becomes 800 g. Agitation is continued for 5 minutes after the last drop of methanol is added. By performing solvent removal through an alcohol (methanol) drip in this way, it is possible to solidify the toner particles in an extremely short period of time.

Next, the emulsion is filtered and dried in the following manner to obtain a toner. Specifically, as the toner particles are deposited within 5 minutes of cessation of agitation during solvent removal, the supernatant liquid is discarded and the deposited toner particles are suction-filtered. The toner particles, which have formed a cake-like form after filtration, are then broken into flakes having a height of approximately 1 cm, and by drying the flakes in a 50° C. oven for 24 hours or more, the toner particles are obtained.

The emulsion contains 48.0 g of butyl acetate and a total amount of 159.6 g of water. The total amount of water is calculated by adding the 155.8 g distilled water and the amount of water contained in the 10 weight percent TCP. Water represents 90% of the 10 weight percent TCP, and 4.2 g of the 10 weight percent TCP was used. Accordingly, approximately 3.8 g of water is contained in the 10 weight percent TCP (i.e., 0.9*4.2 g). Thus, the total amount of water present in the emulsion is 155.8 g distilled water+approximately 3.8 g water from the 10 weight percent TCP, for a total amount of 159.6 g water.

The phase point amount of the amphiphilic solvent methanol is 176.6 g. That is, the phase point amount of 176.6 g is, as described above, the amount of methanol dripped into the solution containing 48.0 g butyl acetate and a total amount of 159.6 g water to the point that the solution becomes clear and colorless (the measurement of the phase point amount was performed separately from this toner manufacture, and is the same as below).

The amount of methanol added during the additive process is 80.0 g. Therefore, the amount of methanol added during the additive process (the amount of mother liquid) is 0.453 times greater than the phase point of methanol in the butyl acetate and the water. Further, the solubility of butyl acetate in water is 0.8.

EXAMPLE 2

Toner is manufactured in basically the same method as was described in Example 1. However, in Example 2, as illustrated in Table 1, the water-based solvent is obtained as follows: Distilled water: 115.8 g; 10 weight percent TCP: 4.2 g; and Methanol: 120.0 g.

In the toner manufacturing method in Example 2, the emulsion liquid contains 48.0 g butyl acetate and a total amount of 119.6 g of water, and the phase point amount of the methanol is 148.0 g. The 148.0 g phase point amount is, as described above, the amount of methanol dripped into the solution containing 48.0 g butyl acetate and 119.6 g water to the point that the solution becomes clear and colorless. Thus, the 120 g of methanol added is 0.811 times greater than the phase point amount of 148.0 g. Moreover, the solubility of the organic solvent butyl acetate in water is 0.8.

EXAMPLE 3

Toner is manufactured in basically the same method as was described in Example 1. However, in Example 3, as illustrated in Table 1, the water-based solvent is obtained as follows: Distilled water: 85.8 g; 10 weight percent TCP: 4.2 g; and Methanol: 150.0 g.

In the toner manufacturing method in Example 3, the emulsion liquid contains 48.0 g butyl acetate and a total amount of 89.6 g of water, and the phase point amount of the methanol is 125.7 g. The 125.7 g phase point amount is, as described above, the amount of methanol dripped into the solution containing 48.0 g butyl acetate and 89.6 g water to the point that the solution becomes clear and colorless. Thus, the 150.0 g of methanol added is 1.194 times greater than the phase point amount. Moreover, the solubility of the organic solvent butyl acetate in water is 0.8.

EXAMPLE 4

Toner is manufactured in basically the same method as was described in Example 1. However, in Example 4, as illustrated in Table 1, 48.0 g of toluene is used as the. organic solvent in lieu of 48.0 g of butyl acetate. In addition, the water-based solvent is obtained as follows: Distilled water: 85.8 g; 10 weight percent TCP: 4.2 g; and Acetone (amphiphilic solvent): 150.0 g.

In the toner manufacturing method in Example 4, the emulsion liquid contains 48.0 g toluene and 89.6 g of water, and the phase point amount of the acetone is 256.7 g. The 256.7 g phase point amount is, as described above, the amount of acetone dripped into the solution containing 48.0 g toluene and 89.6 g water to the point that the solution becomes clear and colorless. Thus, the amount of 150.0 g of acetone added is 0.584 times greater than the phase point amount. Moreover, the solubility of the organic solvent toluene in water is 0.045.

EXAMPLE 5

Toner is manufactured in basically the same method as was described in Example 1. However, in Example 5, as illustrated in Table 1, 48.0 g of toluene is used as the organic solvent in lieu of 48.0 g of butyl acetate. In addition, the water-based solvent is obtained as follows: Distilled water: 35.8 g; 10 weight percent TCP: 4.2 g; and Acetone (amphiphilic solvent): 200.0 g.

In the toner manufacturing method in Example 5, the emulsion liquid contains 48.0 g toluene and 39.6 g of water, and the phase point amount of the acetone is 167.5 g. The 167.5 g phase point amount is, as described above, the amount of acetone dripped into the solution containing 48.0 g toluene and 39.6 g water to the point that the solution becomes clear and colorless. Thus, the amount of 200.0 g of acetone added is 1.194 times greater than the phase point amount. Moreover, the solubility of the organic solvent toluene in water is 0.045.

EXAMPLE 6

Toner is manufactured in basically the same method as was described in Example 1. However, in Example 6, as illustrated in Table 1, 48.0 g of chloroform is used as the organic solvent in lieu of 48.0 g of butyl acetate. In addition, the water-based solvent is obtained as follows: Distilled water: 135.8 g; 10 weight percent TCP: 4.2 g; and Isopropyl Alcohol (IPA, amphiphilic solvent): 100.0 g.

In the toner manufacturing method in Example 6, the emulsion liquid contains 48.0 g chloroform and 139.6 g of water, and the phase point amount of the IPA is 132.5 g. The 132.5 g phase point amount is, as described above, the amount of IPA dripped into the solution containing 48.0 g chloroform and 139.6 g water to the point that the solution becomes clear and colorless. Thus, the amount of 100.0 g of PA added is 0.755 times greater than the phase point amount. Moreover, the solubility of the organic solvent chloroform in water is 0.7.

EXAMPLE 7

Toner is manufactured in basically the same method as was described in the Example 1. However, in Example 7, as illustrated in Table 1, 48.0 g of chloroform is used as the organic solvent in lieu of 48.0 g of butyl acetate. In addition, the water-based solvent is obtained as follows: Distilled water: 85.8 g; 10 weight percent TCP: 4.2 g; and IPA (amphiphilic solvent): 150.0 g.

In the toner manufacturing method in Example 7, the emulsion liquid contains 48.0 g chloroform and 89.6 g of water, and the phase point amount of the IPA is 110.9 g. The 110.9 g phase point amount is, as described above, the amount of IPA dripped into the solution containing 48.0 g chloroform and 89.6 g water to the point that the solution becomes clear and colorless. Thus, the amount of 150.0 g of IPA added is 1.353 times greater than the phase point amount. Moreover, the solubility of the organic solvent chloroform in water is 0.7.

EXAMPLE 8

Toner is manufactured in basically the same method as was described in Example 1. However, in Example 8, as illustrated in Table 1, 48.0 g of 2-hexanone is used as the organic solvent in lieu of 48.0 g of butyl acetate. In addition, the water-based solvent is obtained as follows: Distilled water: 115.8 g; 10 weight percent TCP: 4.2 g; and IPA (amphiphilic solvent): 120.0 g.

In the toner manufacturing method in Example 8, the emulsion liquid contains 48.0 g 2-hexanone and 119.6 g of water, and the phase point amount of the IPA is 109.6 g. The 109.6 g phase point amount is, as described above, the amount of IPA dripped into the solution containing 48.0 g 2-hexanone and 119.6 g water to the point that the solution becomes clear and colorless. Thus, the amount of 120.0 g of IPA added is 1.094 times greater than the phase point amount. Moreover, the solubility of the organic solvent 2-hexanone in water is 1.7.

EXAMPLE 9

Toner is manufactured in basically the same method as was described in Example 1. However, in Example 9, as illustrated in Table 1, 48.0 g of 2-hexanone is used as the organic solvent in lieu of 48.0 g of butyl acetate. In addition, the water-based solvent is obtained as follows: Distilled water: 75.8 g; 10 weight percent TCP: 4.2 g; and IPA (amphiphilic solvent): 160.0 g.

In the toner manufacturing method in Example 9, the emulsion liquid contains 48.0 g 2-hexanone and 79.6 g of water, and the phase point amount of the IPA is 93.1 g. The 93.1 g phase point amount is, as described above, the amount of IPA dripped into the solution containing 48.0 g 2-hexanone and 79.6 g water to the point that the solution becomes clear and colorless. Thus, the amount of 160.0 g of IPA added is 1.718 times greater than the phase point amount. Moreover, the solubility of the organic solvent 2-hexanone in water is 1.7.

COMPARATIVE EXAMPLE 2

Toner is manufactured in basically the same method as was described in Example 1. However, in Comparative Example 2, as illustrated in Table 2, the water-based solvent is obtained as follows: Distilled water: 175.8 g; 10 weight percent TCP: 4.2 g; and Methanol: 60.0 g.

In the toner manufacturing method in Comparative Example 2, the emulsion liquid contains 48.0 g butyl acetate and 179.6 g of water, and the phase point amount of the methanol is 190.4 g. The 190.4 g phase point amount is, as described above, the amount of methanol dripped into the solution containing 48.0 g butyl acetate and 179.6 g water to the point that the solution becomes clear and colorless. Thus, the amount of 60.0 g of methanol added is 0.315 times greater than the phase point amount and falls outside of the scope of this invention.

COMPARATIVE EXAMPLE 3

Toner is manufactured in basically the same method as was described in Example 1. However, in Comparative Example 3, as illustrated in Table 2, the water-based solvent is obtained as follows: Distilled water: 35.8 g; 10 weight percent TCP: 4.2 g; and Methanol: 200.0 g.

In the toner manufacturing method in Comparative Example 3, the emulsion liquid contains 48.0 g butyl acetate and 39.6 g of water, and the phase point amount of the methanol is 86.1 g. The 86.1 g phase point amount is, as described above, the amount of methanol dripped into the solution containing 48.0 g butyl acetate and 39.6 g water to the point that the solution becomes clear and colorless. Thus,

TABLE 2

| | | | Comparative Example | | | | | | | | | | |
|---|---|---|---|---|---|---|---|---|---|---|---|---|---|
| | | | 1 | 2 | 3 | 4 | 5 | 6 | 7 | 8 | 9 | 10 | 11 |
| Oil-based Solvent | Organic Solvent | Butyl Acetate (g) | 48.0 | 48.0 | 48.0 | | | | | | | | |
| | | Toluene (g) | | | | 48.0 | 48.0 | 48.0 | | | | | |
| | | Chloroform (g) | | | | | | | 48.0 | 48.0 | 48.0 | | |
| | | 2-Haxanone (g) | | | | | | | | | | 48.0 | 48.0 |
| | Polymer Resin | Polyester Resin (PES) (g) | 12.0 | 12.0 | 12.0 | 12.0 | 12.0 | 12.0 | 12.0 | 12.0 | 12.0 | 12.0 | 12.0 |
| | Wax (g) | | 0.5 | 0.5 | 0.5 | 0.5 | 0.5 | 0.5 | 0.5 | 0.5 | 0.5 | 0.5 | 0.5 |
| | Pigment (g) | | 0.6 | 0.6 | 0.6 | 0.6 | 0.6 | 0.6 | 0.6 | 0.6 | 0.6 | 0.6 | 0.6 |
| | Total (g) | | 61.1 | 61.1 | 61.1 | 61.1 | 61.1 | 61.1 | 61.1 | 61.1 | 61.1 | 61.1 | 61.1 |
| Aqueous Solvent | Distilled Water (g) | | 235.8 | 175.8 | 35.8 | 235.8 | 155.8 | 5.8 | 235.8 | 185.8 | 35.8 | 235.8 | 55.8 |
| | Amphiphilic Solvent | Methanol (g) | | 60.0 | 200.0 | | | | | | | | |
| | | Acetone (g) | | | | | 80.0 | 230.0 | | | | | |
| | | IPA (g) | | | | | | | | 50.0 | 200.0 | | 180.0 |
| | Dispersion Stabilizer | 10% TCP (g) | 4.2 | 4.2 | 4.2 | 4.2 | 4.2 | 4.2 | 4.2 | 4.2 | 4.2 | 4.2 | 4.2 |
| | Total Distilled Water (g) | | 239.6 | 179.6 | 39.6 | 239.6 | 159.6 | 9.6 | 239.6 | 189.6 | 39.6 | 239.6 | 59.6 |
| | Total (g) | | 240.0 | 240.0 | 240.0 | 240.0 | 240.0 | 240.0 | 240.0 | 240.0 | 240.0 | 240.0 | 240.0 |
| Properties | Phase Point Amount (g) | | 230.3 | 190.4 | 86.1 | 398.8 | 336.6 | 95.5 | 160.3 | 148.0 | 77.2 | 147.0 | 82.9 |
| | Ratio of Amount of Amphiphilic Solvent Added During Additive Process to Phase Point Amount | | 0.000 | 0.315 | 2.324 | 0.000 | 0.238 | 2.409 | 0.000 | 0.338 | 2.591 | 0.000 | 2.171 |
| | Solubility | | 0.8 | 0.8 | 0.8 | 0.045 | 0.045 | 0.045 | 0.7 | 0.7 | 0.7 | 1.7 | 1.7 |
| | Oil-phase Ratio | | 16.7 | 21.1 | 54.8 | 16.7 | 23.1 | 83.4 | 16.7 | 20.2 | 54.8 | 16.7 | 44.6 |
| | SEM Observed Data | | 0 | 0 | −1 | 0 | 0 | −1 | 0 | 0 | −1 | 0 | −1 |
| | Roundness | | 0.78 | 0.89 | * | 0.82 | 0.90 | * | 0.78 | 0.88 | * | 0.83 | * |
| | Yield (%) | | 92.0 | 84.6 | 46.8 | 94.0 | 89.4 | 2.7 | 93.0 | 87.4 | 0.0 | 95.0 | 20.4 |

COMPARATIVE EXAMPLE 1

Toner is manufactured in basically the same method as was described in Example 1. However, in Comparative Example 1, as illustrated in Table 2, the water-based solvent is obtained as follows: Distilled water: 235.8 g; and 10 weight percent TCP: 4.2 g. In Comparative Example 1, no amphiphilic solvent was added to the water-based solvent, and this comparative example thus falls outside of the scope of this invention.

the amount of 200.0 g of methanol added is 2.324 times greater than the phase point amount, and falls outside of the scope of this invention.

COMPARATIVE EXAMPLE 4

Toner is manufactured in basically the same method as was described in Example 1. However, in Comparative Example 4, as illustrated in Table 2, 48.0 g of toluene is used as the organic solvent in lieu of 48.0 g of butyl acetate. In addition, the water-based solvent is obtained as follows: Distilled water: 235.8 g; and 10 weight percent TCP: 4.2 g. In Comparative Example 4, no amphiphilic solvent is added to the water-based solvent, and this comparative example thus falls outside of the scope of this invention.

COMPARATIVE EXAMPLE 5

Toner is manufactured in basically the same method as was described in Example 1. However, in Comparative Example 5, as illustrated in Table 2, 48.0 g of toluene is used as the organic solvent in lieu of 48.0 g of butyl acetate. In addition, the water-based solvent is obtained as follows: Distilled water: 155.8 g; 10 weight percent TCP: 4.2 g; and Acetone (amphiphilic solvent): 80.0 g.

In the toner manufacturing method in Comparative Example 5, the emulsion liquid contains 48.0 g toluene and 159.6 g of water, and the phase point amount of the acetone is 336.6 g. The 336.6 g phase point amount is, as described above, the amount of acetone dripped into the solution containing 48.0 g toluene and 159.6 g water to the point that the solution becomes clear and colorless. Thus, the amount of 80.0 g of acetone added is 0.238 times greater than the phase point amount, and falls outside of the scope of this invention.

COMPARATIVE EXAMPLE 6

Toner is manufactured in basically the same method as was described in Example 1. However, in Comparative Example 6, as illustrated in Table 2, 48.0 g of toluene is used as the organic solvent in lieu of 48.0 g of butyl acetate. In addition, the water-based solvent is obtained as follows: Distilled water: 5.8 g; 10 weight percent TCP: 4.2 g; and Acetone (amphiphilic solvent): 230.0 g.

In the toner manufacturing method in Comparative Example 6, the emulsion liquid contains 48.0 g toluene and 9.6 g of water, and the phase point amount of the acetone is 95.5 g. The 95.5 g phase point amount is, as described above, the amount of acetone dripped into the solution containing 48.0 g toluene and 9.6 g water to the point that the solution becomes clear and colorless. Thus, the amount of 230.0 g of acetone added is 2.409 times greater than the phase point amount, and falls outside of the scope of this invention.

COMPARATIVE EXAMPLE 7

Toner is manufactured in basically the same method as was described in Example 1. However, in Comparative Example 7, as illustrated in Table 2, 48.0 g of chloroform is used as the organic solvent in lieu of 48.0 g of butyl acetate. In addition, the water-based solvent is obtained as follows: Distilled water: 235.8 g; and 10 weight percent TCP: 4.2 g. In Comparative Example 7, no amphiphilic solvent is added to the water-based solvent, and this comparative example thus falls outside of the scope of this invention.

COMPARATIVE EXAMPLE 8

Toner is manufactured in basically the same method as was described in Example 1. However, in Comparative Example 8, as illustrated in Table 2, 48.0 g of chloroform is used as the organic solvent in lieu of 48.0 g of butyl acetate. In addition, the water-based solvent is obtained as follows: Distilled water: 185.8 g; 10 weight percent TCP: 4.2 g; and IPA (amphiphilic solvent): 50.0 g.

In the toner manufacturing method in Comparative Example 8, the emulsion liquid contains 48.0 g chloroform and 189.6 g of water, and the phase point amount of the IPA is 148.0 g. The 148.0 g phase point amount is, as described above, the amount of IPA dripped into the solution containing 48.0 g chloroform and 189.6 g water to the point that the solution becomes clear and colorless. Thus, the amount of 50.0 g of IPA added is 0.338 times greater than the phase point amount, and falls outside of the scope of this invention.

COMPARATIVE EXAMPLE 9

Toner is manufactured in basically the same method as was described in Example 1. However, in Comparative Example 9, as illustrated in Table 2, 48.0 g of chloroform is used as the organic solvent in lieu of 48.0 g of butyl acetate. In addition, the ingredients for the water-based solvent is obtained as follows: Distilled water: 35.8 g; 10 weight percent TCP: 4.2 g; and IPA (amphiphilic solvent): 200.0 g.

In the toner manufacturing method in Comparative Example 9, the emulsion liquid contains 48.0 g chloroform and 39.6 g of water, and the phase point amount of the IPA is 77.2 g. The 77.2 g phase point amount is, as described above, the amount of IPA dripped into the solution containing 48.0 g chloroform and 39.6 g water to the point that the solution becomes clear and colorless. Thus, the amount of 200.0 g of IPA added is 2.591 times greater than the phase point amount, and falls outside of the scope of this invention.

COMPARATIVE EXAMPLE 10

Toner is manufactured in basically the same method as was described in Example 1. However, in Comparative Example 10, as illustrated in Table 2, 48.0 g of 2-hexanone is used as the organic solvent in lieu of 48.0 g of butyl acetate. In addition, the ingredients for the water-based solvent is obtained as follows: Distilled water: 235.8 g; and 10 weight percent TCP: 4.2 g. In Comparative Example 10, no amphiphilic solvent is added to the water-based solvent, and this comparative example thus falls outside of the scope of this invention.

COMPARATIVE EXAMPLE 11

Toner is manufactured in basically the same method as was described in Example 1. However, in Comparative Example 11, as illustrated in Table 3, 48.0 g of 2-hexanone is used as the organic solvent in lieu of 48.0 g of butyl acetate. In addition, the water-based solvent is obtained as follows: Distilled water: 55.8 g; 10 weight percent TCP: 4.2 g; and IPA (amphiphilic solvent): 180.0 g.

In the toner manufacturing method in Comparative Example 11, the emulsion liquid contains 48.0 g 2-hexanone and 59.6 g of water, and the phase point amount of the IPA is 82.9 g. The 82.9 g phase point amount is, as described above, the amount of IPA dripped into the solution containing 48.0 g 2-hexanone and 59.6 g water to the point that the solution becomes clear and colorless. Thus, the amount of 180.0 g of IPA added is 2.171 times greater than the phase point amount, and falls outside of the scope of this invention.

The efficacy of the toner manufacturing methods of Examples 1-9 and Comparative Examples 1-11 are evaluated in FIGS. 2-4, described below.

SEM Observation

First of all, in order to remove the TCP adhering to the toner particles, the toner particles are washed for two hours in a dilute hydrochloric acid solution (0.06 standard hydrochloric acid aqueous solution) of an amount 300 times greater than the amount of solid TCP. The toner particles are dried again, and a scan is performed using a scanning electron microscope (SUPERSCAN220, Shimadzu). Next, the form of the toner particles is evaluated using the following standards.

2: Spherical

1: One portion is amorphous

0: Amorphous

−1: The resin is aggregated and there are little particles.

Figure 2:
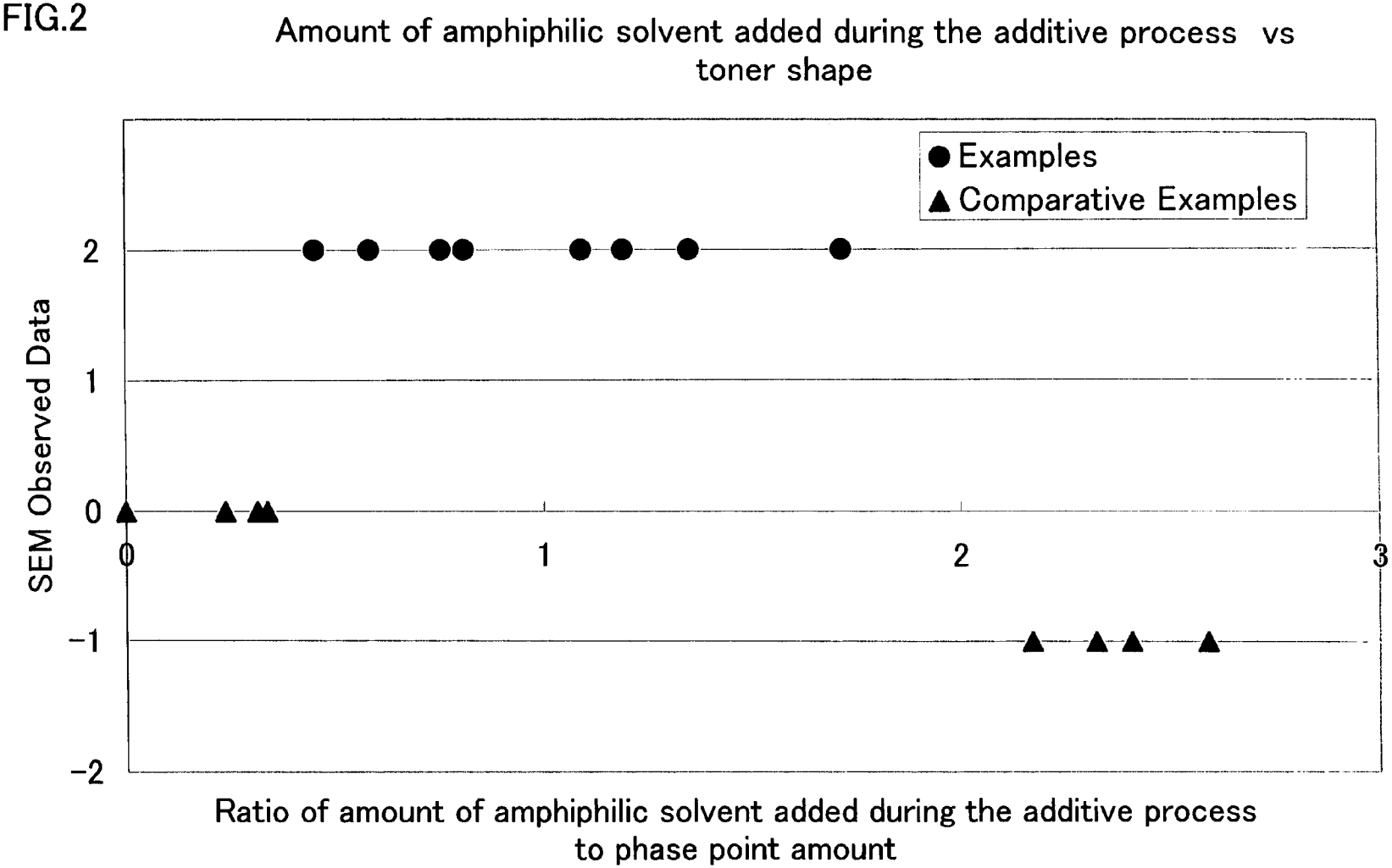
FIG. 2 is a graph showing a relationship between an amount of amphiphilic solvent added and a toner shape of toner particles made by an embodiment of a toner manufacturing method according to the invention.

The results of the SEM observation are illustrated in Tables 1-2 and in FIG. 2.

As shown in Tables 1-2 and in FIG. 2, the form of the toner particles manufactured in Examples 1-9 are all judged to be "2," and are spherical. In contrast, the form of the toner particles manufactured in Comparative Examples 1-11 is either "0" or "−1." Based on these results, it is possible to obtain a spherical toner, even with organic solvents such as butyl acetate, toluene, chloroform or 2-hexanone, which have low solubility in water.

Roundness Measurements

A solution of TRITON X-100 (ACROS), diluted 1:2500 in distilled water, is added to the toner to create a dilute dispersion liquid for the toner. The toner is dispersed by ultrasonically agitating the toner dilute dispersion liquid for 5 minutes. The solution is diluted such that the concentration of the toner dilute dispersion liquid becomes 5000 (units/μl) while measuring the solution in a Particle Image Analyzer (FPIA-1000, Sysmex).

Once the toner concentration of the diluted solution is adjusted, images of the toner particles are taken using the FPIA-1000, and the roundness of the toner particles is measured. The roundness is defined as follows: Roundness=(the circumference of a perfect circle having an area equivalent to that of the image of the toner particle)/(the actual circumference of the image of the toner particle).

Figure 3:
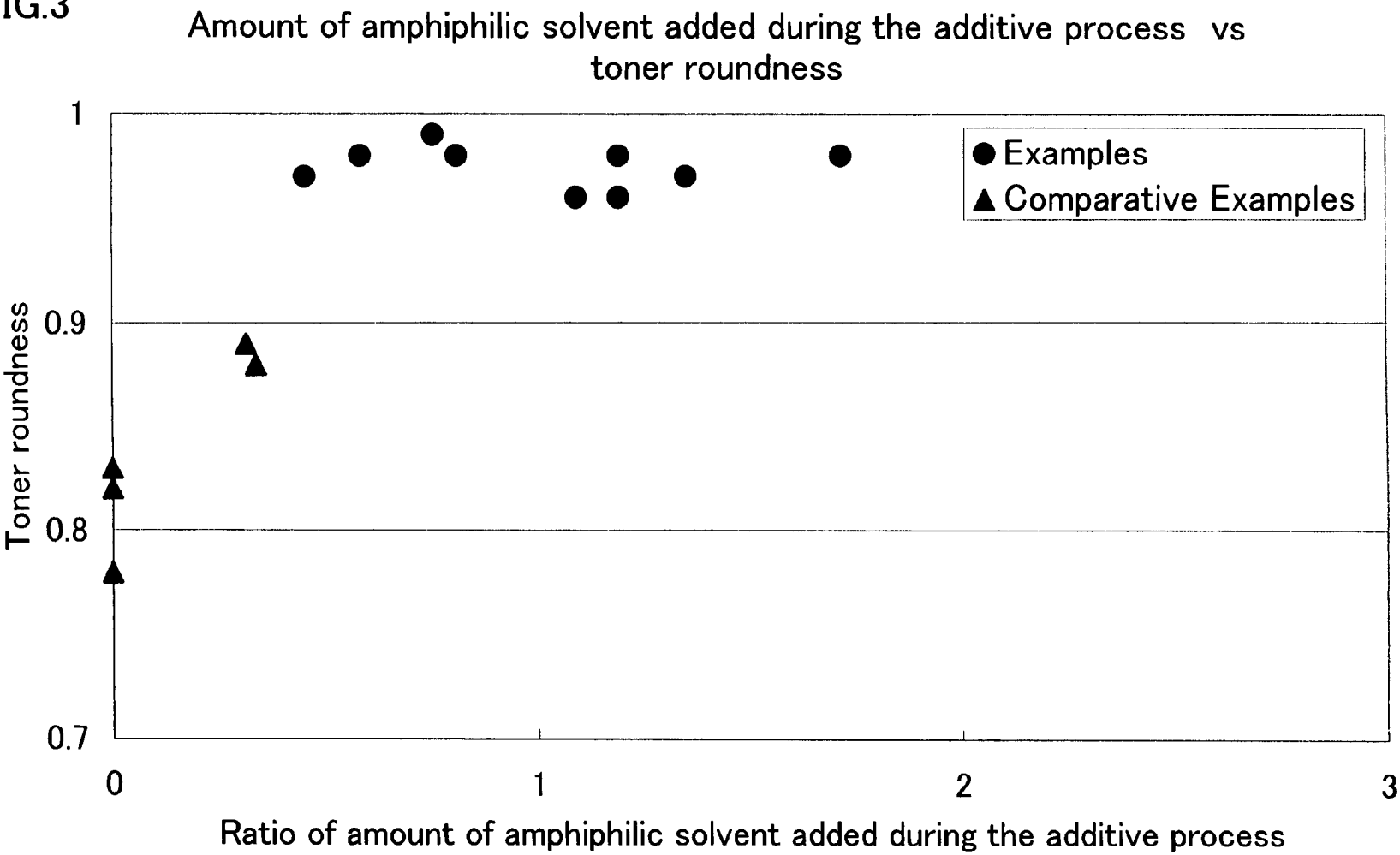
FIG. 3 is a graph showing a relationship between an amount of amphiphilic solvent added and a toner roundness of toner particles made by an embodiment of a toner manufacturing method according to the invention.

The measurement results are shown in Tables 1-2 and in FIG. 3. In these measurements, the average was taken of the data for 100 units of toner. particles. For those examples where the toner did not form particles, * has been entered into Tables 1-2 as it is not possible to display the roundness as a value. Further, the data for those examples are not displayed in FIG. 3. As is shown in Tables 1-2, the roundness of the toner particles manufactured in each of Examples 1-9 is 0.96 or greater for all of them. In contrast, the roundness of the toner particles manufactured in each of Comparative Examples 1-11 is 0.90 or less for all of them. Based on these results, it is possible to obtain a spherical toner, even with organic solvents such as butyl acetate, toluene, chloroform or 2-hexanone, which have low solubility in water.

Yield Measurements

The yield is calculated using the theoretical amount of toner obtained and the actual amount of toner obtained. The theoretical amount of toner obtained is calculated using the amounts of the raw ingredients. The results are shown in Tables 1-2 and in FIG. 4.

Figure 4:
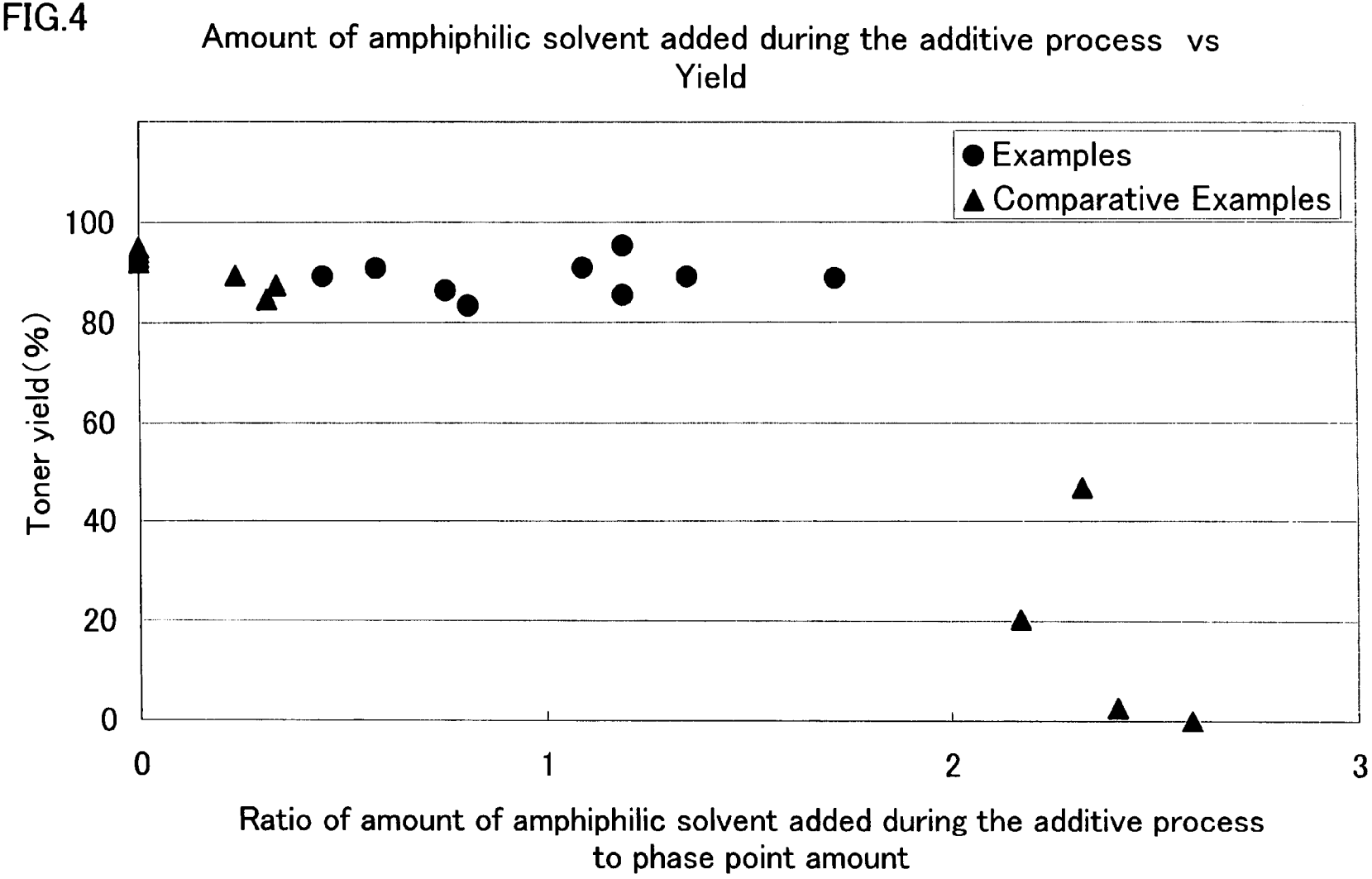
FIG. 4 is a graph showing a relationship between an amount of amphiphilic solvent added and a toner yield of toner particles made by an embodiment of a toner manufacturing method according to the invention.

As is shown in Tables 1-2 and in FIG. 4, the yield for Embodiments 1-9 is 83 weight percent or greater. In contrast, the yields for Comparative Examples 3, 6, 9 and 11 are 46.8 weight percent, 2.7 weight percent, 0 weight percent and 20.4 weight percent, respectively. The amount of amphiphilic solvent added in Comparative Examples 3, 6, 9 and 11 is more than 1.8 times greater than the phase point amount of the amphiphilic solvent in the water and the organic solvent. Based on these results, it is possible to obtain a spherical toner at a high yield through the manufacturing methods in Examples 1-9.

In Tables 1-2, the oil-phase ratio and the solubility are noted for each Example and Comparative Example. The oil-phase ratio is defined as follows: Oil-phase ratio=(Weight of organic solvent/(Weight of the organic solvent+Total weight of distilled water))×100. Furthermore, the solubility refers to the point when the organic solvent is maximally dissolved in water, and is defined as follows: Solubility={(weight of organic solvent)/((weight of organic solvent)+(weight of water))}×100.

As used herein, the term "emulsify" means "to disperse one of two incompletely miscible liquids in the other in the form of fine droplets/particles," and "emulsion" was used to mean "a disperse system in which both phase are liquids." Although the term "suspend" means "to disperse a finely divided solid in a solid, liquid or gas," and the term "suspension" means "a two-phase system consisting of a finely divided solid dispersed in a solid, liquid or gas," the terms "suspend" and "suspension" are commonly used in lieu of "emulsify" and "emulsion" in technical fields to which this invention belongs. Thus, at times the term "suspend" is used to mean "to disperse one of two incompletely miscible liquids in the other in the form of fine droplets/particles," and the term "suspension" is used mean "a disperse system in which both phase are liquids." This invention is intended to encompass the dispersion of one of two incompletely miscible liquids in the other in the form of fine droplets/particles, regardless of whether the term "emulsify" or "suspend" is used. Furthermore, this invention is intended to encompass a disperse system in which both phase are liquids, regardless of whether the terms "emulsion" or "suspension" is used.

This invention is not limited to the above embodiments, and it goes without saying that it is possible for this invention to take on a wide variety of aspects while not diverging from the scope of this invention.

What is claimed is:

1. A method for manufacturing toner, the method comprising the steps of:

a first combining step of combining a polymer resin and an organic solvent to obtain an oil-based solvent;

a second combining step of combining a dispersion stabilizer with water to obtain a water-based solvent;

an emulsification step of emulsifying the oil-based solvent in the water-based solvent to form emulsion particles; and a solvent removal step of removing the organic solvent from the emulsion particles;

wherein the second combining step includes an additive step of adding an amphiphilic solvent to the dispersion stabilizer, the water, or a mixture of the dispersion stabilizer and the water, wherein the amphiphilic solvent is added in an amount of about 0.4 to about 1.8 times greater than a phase point amount of the amphiphilic solvent in a mixture of the organic solvent and water.

2. The method of claim 1, wherein, in the additive step, the amphiphilic solvent is added in an amount of about 0.45 to about 1.75 times greater than a phase point amount of the amphiphilic solvent in a mixture of the organic solvent and the water.

3. The method of claim 1, wherein, in the additive step, the amphiphilic solvent is added to the water, before the dispersion stabilizer is combined with the water.

4. The method of claim 1, wherein, in the additive step, the amphiphilic solvent is added to the mixture of the dispersion stabilizer and the water, after the dispersion stabilizer is combined with the water.

5. The method of claim 1, wherein the amphiphilic solvent is at least one member selected from the group consisting of methanol, acetone and isopropyl alcohol.

6. The method of claim 1, wherein the amphiphilic solvent is two or more members selected from the group consisting of methanol, isopropyl alcohol, ethanol, propanol and acetone.

7. The method of claim 1, wherein the organic solvent has a solubility in water of about 1.7 or less.

8. The method of claim 1, wherein the organic solvent is selected from the group consisting of butyl acetate, propyl acetate, toluene, xylene, 2-hexanone, methyl isobutyl ketone, cyclohexanone, dibutylether, dihexylether, chloroform and chlorobenzene.

9. The method of claim 1, wherein the organic solvent is butyl acetate.

10. The method of claim 1, wherein the polymer resin is selected from the group consisting of polyester resins, styrene-acryl copolymers, ketone resins, epoxy resins and polyolefin resins.

11. The method of claim 1, wherein the polymer resin is a polyester resin.

12. The method of claim 1, wherein the dispersion stabilizer is selected from the group consisting of calcium phosphate, silica, alumina, titania, calcium carbonate, magnesium carbonate, clay, diatomaceous earth and bentonite.

13. The method of claim 1, wherein a wax is added to the oil-based solvent.

14. The method of claim 13, wherein the wax is a polyethylene wax.

15. The method of claim 1, wherein a coloring agent is added to the oil-based solvent.

16. The method of claim 15, wherein the coloring agent is selected from the group consisting of carbon black, magnetic powder, cyan, magenta and yellow.

17. The method of claim 1, wherein the organic solvent is removed from the emulsion particles by at least one treatment selected from the group consisting of a heat treatment, a vacuum treatment, an alcohol drip treatment, and a spray treatment.

18. The method of claim 17, further comprising the steps of filtering and drying the emulsion particles, wherein the method produces toner with toner particles having a roundness of 0.96 or greater.

19. The method of claim 18, wherein the method has a toner yield of 83% or greater.

20. The method of claim 1, wherein the emulsion particles have a size ranging from about 1 μm to about 20 μm.

* * * * *